US008054008B2

(12) United States Patent
Kimura

(10) Patent No.: US 8,054,008 B2
(45) Date of Patent: Nov. 8, 2011

(54) POWER CONVERTER

(75) Inventor: Kengo Kimura, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 238 days.

(21) Appl. No.: 12/507,304

(22) Filed: Jul. 22, 2009

(65) Prior Publication Data

US 2010/0019696 A1 Jan. 28, 2010

(30) Foreign Application Priority Data

Jul. 25, 2008 (JP) ..... 2008-192116

(51) Int. Cl.
*H05B 37/02* (2006.01)

(52) U.S. Cl. ..... 315/307; 315/209 R; 315/284

(58) Field of Classification Search ..... 315/210, 315/212, 246, 247, 291, 209 R, 294, 307, 315/308; 345/82, 83, 204
See application file for complete search history.

(56) References Cited

U.S. PATENT DOCUMENTS

| | | | | |
|---|---|---|---|---|
| 5,615,093 | A | 3/1997 | Nalbant | |
| 5,930,121 | A | 7/1999 | Henry | |
| 6,940,733 | B2 | 9/2005 | Schie et al. | |
| 7,408,308 | B2 | 8/2008 | Sawada et al. | |
| 7,579,786 | B2 | 8/2009 | Soos | |
| 7,714,516 | B2 * | 5/2010 | Ito et al. | 315/291 |
| 7,781,978 | B2 * | 8/2010 | Kitagawa | 315/82 |
| 7,781,982 | B2 * | 8/2010 | Tatsumi | 315/291 |
| 7,855,520 | B2 * | 12/2010 | Leng | 315/307 |
| 2008/0055948 | A1 | 3/2008 | Wu et al. | |
| 2008/0100230 | A1 | 5/2008 | Lin | |
| 2008/0297058 | A1 | 12/2008 | Soos | |
| 2009/0122003 | A1 | 5/2009 | Chen et al. | |
| 2009/0315467 | A1 | 12/2009 | Schindler et al. | |

FOREIGN PATENT DOCUMENTS

| | | |
|---|---|---|
| JP | 10-50489 | 2/1998 |
| JP | 2005-71681 | 3/2005 |

OTHER PUBLICATIONS

U.S. Appl. No. 12/507,313, filed Jul. 22, 2009, Kimura.

* cited by examiner

*Primary Examiner* — Don Le
(74) *Attorney, Agent, or Firm* — Oblon, Spivak, McClelland, Maier & Neustadt, L.L.P.

(57) ABSTRACT

The present invention includes a first DC converter converting AC voltage, into DC voltage while correcting a power factor, and a second DC converter electrically isolating the first DC converter from an LED group load, and converting the DC voltage, into a predetermined DC voltage and supply the resultant voltage to the LED group load. The second DC converter includes a current detection circuit disposed on the secondary side, and detecting current flowing into the LED group load, an error amplifier amplifying an error between a detected current value detected and a reference current value, a signal transmission isolation element transmitting a control signal based on an output signal from the error amplifier, to the primary side, and a switching element transferring power to the secondary side through the transformer by being turned on/off according to the control signal.

18 Claims, 15 Drawing Sheets

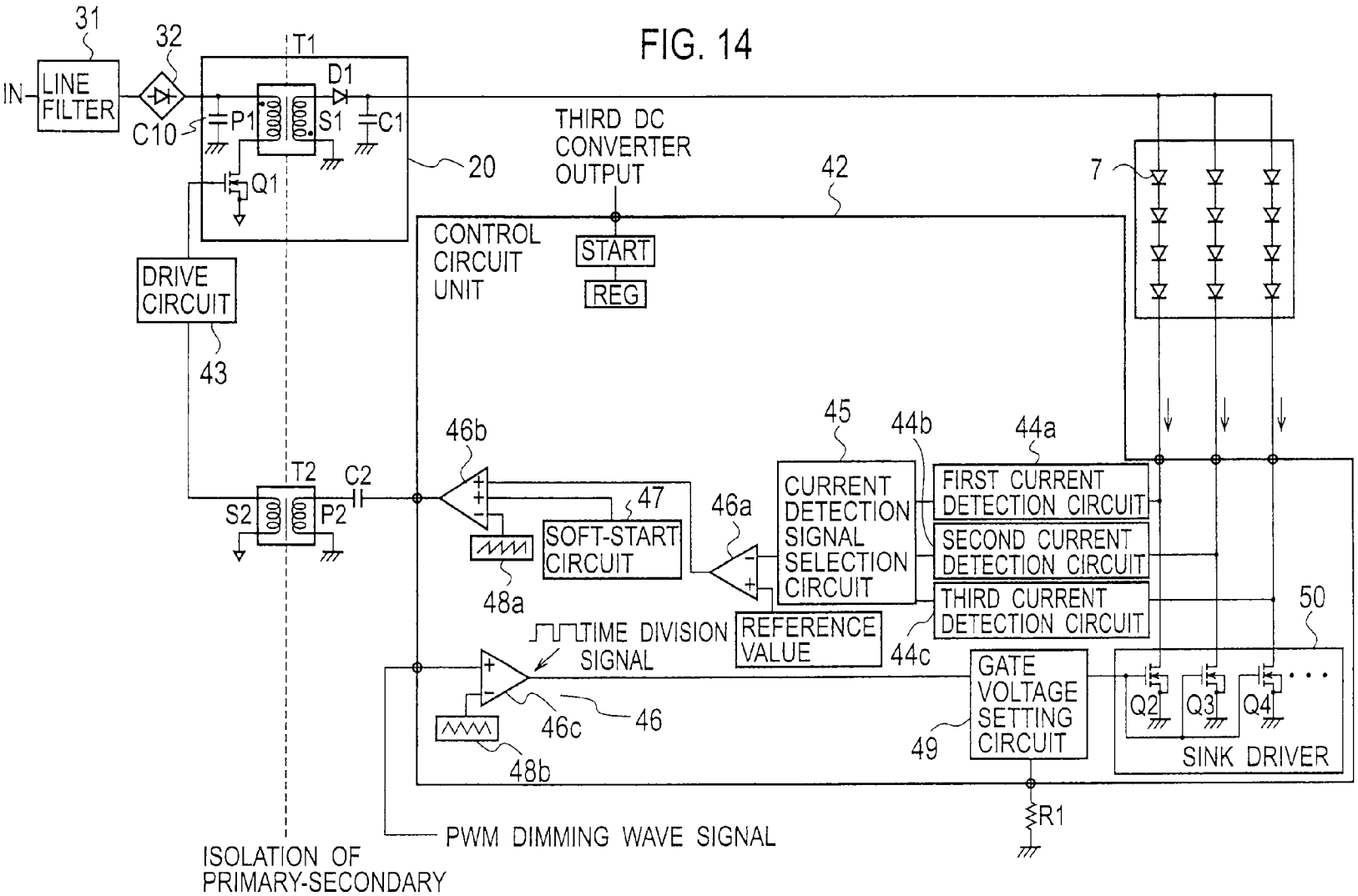
FIG. 14
IN
31
LINE FILTER
32
C10
20
T1
D1
S1
C1
P1
Q1
DRIVE CIRCUIT
43
T2
S2
P2
C2
ISOLATION OF PRIMARY-SECONDARY
THIRD DC CONVERTER OUTPUT
START
REG
CONTROL CIRCUIT UNIT
42
46b
48a
47
SOFT-START CIRCUIT
46a
45
CURRENT DETECTION SIGNAL SELECTION CIRCUIT
44b
44a
FIRST CURRENT DETECTION CIRCUIT
SECOND CURRENT DETECTION CIRCUIT
THIRD CURRENT DETECTION CIRCUIT
44c
REFERENCE VALUE
TIME DIVISION SIGNAL
46
46c
48b
PWM DIMMING WAVE SIGNAL
GATE VOLTAGE SETTING CIRCUIT
49
R1
7
50
SINK DRIVER
Q2
Q3
Q4

POWER CONVERTER

TECHNICAL FIELD

The present invention relates to an inexpensive and highly-efficient power converter achieved by reducing the number of power conversions.

BACKGROUND ART

FIG. 1 is a circuit configuration diagram showing an example of a conventional power converter. In FIG. 1, a commercial power supply 1 (50 Hz or 60 Hz, AC 80 V to 260 V) and a liquid crystal television (TV) system 2*i* are provided. The liquid crystal TV system 2*i* includes a first direct current (DC) converter 3', a second DC converter 4', a third DC converter 5', a backlight (B/L) 6 having electric discharge tubes 60*a* and 60*b*, a liquid crystal driver 8, an image processing circuit 9, a speaker 10 and a direct current-alternating current (DC-AC) converter 15 having a leakage transformer.

The first DC converter 3' is configured to convert AC voltage from the commercial power supply 1, into DC voltage (DC 380 V, for example), and also to correct the power factor. The second DC converter 4' is a main power supply, and is configured to isolate the primary side and the secondary side from each other, and to convert the DC voltage from the first DC converter 3', into predetermined DC voltage (DC 24 V, for example). The DC-AC converter 15 is configured to convert the DC voltage into AC voltage (65 kHz, AC 1500 Vrms, for example), and to thereby light the electric discharge tubes 60*a* and 60*b*.

The second DC converter 4' is configured to supply the predetermined DC voltage to the liquid crystal driver 8 to drive the liquid crystal driver 8. The third DC converter 5' is configured to electrically isolate the first DC converter 3' from the image processing circuit 9 and the speaker 10, and also to convert the DC voltage from the first DC converter 3', into DC 12 V and DC 36 V and then supply DC 12 V and DC 36V respectively to the image processing circuit 9 and the speaker 10 to drive the image processing circuit 9 and the speaker 10.

Thus, the power converter shown in FIG. 1 is capable of causing the electric discharge tubes 60*a* and 60*b* to emit light by converting the AC power (voltage) from the commercial power supply 1 into high-voltage and high-frequency AC power (voltage).

As techniques of such a conventional kind of power converter, those described in Japanese Patent Application Publications Nos. 2005-71681 and Hei 10-50489, U.S. Pat. No. 5,930,121 (the second paragraph in the Detailed Description of the Invention), and U.S. Pat. No. 5,615,093 (FIG. 3) are known, for example.

However, in the power converter shown in FIG. 1, a power conversion is performed three times in total, that is, power conversions in the first DC converter 3', the second DC converter 4', the DC-AC converter 15, during power transfer from the commercial power supply 1 to the B/L 6 which includes the electric discharge tubes 60*a* and 60*b*, and consumes the largest load power.

Methods for reducing power consumption (save energy) in an LCD-TV are, for example, to enhance the luminance efficiency of a light source itself and to enhance the power conversion efficiency of each power conversion block. In addition to these methods, another effective method is to reduce the number of power conversions to be performed before the power reaches a light source requiring the greatest power.

While a light-emitting diode (LED) can be lit with DC voltage, application voltage (drive voltage) of the LED is determined on the basis of the IF-VF characteristics and the temperature characteristics of the LED. For this reason, when the LED is controlled to emit light with constant luminance (constant current is supplied), basically, the drive voltage of the LED cannot be used directly as input voltage of another load circuit since some variations occur in the drive voltage. In addition, in the case of home appliances, such as TVs, which people can easily touch, the commercial power supply 1 and the B/L 6 need to be electrically isolated from each other for safety.

In the case of the power converter shown in FIG. 1, it is also conceivable to omit the second DC converter 4' and input an output of the first DC converter 3' directly to the DC-AC converter 15, for example. In this case, however, isolation between the primary side and the secondary side is made at the leakage transformer in the DC-AC converter 15 where input and output voltages both are high. This leads to problems of an increase in the price of the transformer and causing eddy current loss at a conductive pattern of a peripheral printed circuit board (PCB) due to high leakage flux from the transformer. For this reason, it is more ideal if isolation between the primary side and the secondary side is made in one of the DC converters.

SUMMARY OF INVENTION

The present invention provides an inexpensive and highly-efficient power converter which is capable of converting AC voltage from an AC power supply, into DC voltage and of driving an electrically isolated LED group load with the DC voltage, and which performs a reduced number of power conversions in the course from the AC power supply to the LED group load.

A first aspect of the present invention provides a power converter including: a first direct current converter configured to convert alternating current voltage from an alternating current power supply, into direct current voltage, and to correct a power factor; an LED group load configured to emit light with predetermined direct current voltage; and a second direct current converter configured to electrically isolate the first direct current converter and the LED group load from each other, and to convert the direct current voltage from the first direct converter, into the predetermined direct current voltage and then supply the predetermined direct voltage to the LED group load. The second direct current converter includes: a transformer configured to isolate a primary side and a secondary side from each other; a current detection circuit disposed on the secondary side of the transformer, and configured to detect current flowing into the LED group load; an error amplifier configured to amplify an error between a current value detected by the current detection circuit and a reference current value; a signal transmission isolation element configured to transmit a control signal based on an output signal from the error amplifier, to the primary side; and a switching element disposed on the primary side, and configured to transfer power to the secondary side through the transformer by being turned on/off according to the control signal transmitted from the signal transmission isolation element.

A second aspect of the present invention provides a power converter including a first direct current converter configured to electrically isolate an alternating current power supply and an LED group load from each other, and to convert alternating current voltage from the alternating current power supply, into direct current voltage while correcting a power factor, and then supply the direct current voltage to the LED group load. The first direct current converter includes: a transformer configured to isolate a primary side and a secondary side from each other; a current detection circuit disposed on the secondary side of the transformer, and configured to detect current flowing into the LED group load; an error amplifier configured to amplify an error between a current value detected by the current detection circuit and a reference current value; a signal transmission isolation element configured to transmit a control signal based on an output signal from the error amplifier, to the primary side; and a switching element disposed on the primary side, and configured to transfer power to the secondary side through the transformer by being turned on/off according to the control signal transmitted from the signal transmission isolation element.

A third aspect of the present invention provides a power converter including a second direct current converter configured to electrically isolate an alternating current power supply and an LED group load from each other, and to convert alternating current voltage from the alternating current power supply, into direct current voltage and then supply the direct current voltage to the LED group load. The second direct current converter includes: a transformer configured to isolate a primary side and a secondary side from each other; a current detection circuit disposed on the secondary side of the transformer, and configured to detect current flowing into the LED group load; an error amplifier configured to amplify an error between a current value detected by the current detection circuit and a reference current value; a signal transmission isolation element configured to transmit a control signal based on an output signal from the error amplifier, to the primary side; and a switching element disposed on the primary side, and configured to transfer power to the secondary side through the transformer by being turned on/off according to the control signal transmitted from the signal transmission isolation element.

BRIEF DESCRIPTION OF DRAWINGS

FIG. 14 is a circuit configuration diagram of a second DC converter provided in the power converter of Embodiment 7 of the present invention.

DESCRIPTION OF EMBODIMENTS

Embodiments of a power converter of the present invention will be described below in detail with reference to the drawings.

Embodiment 1

Figure 2:
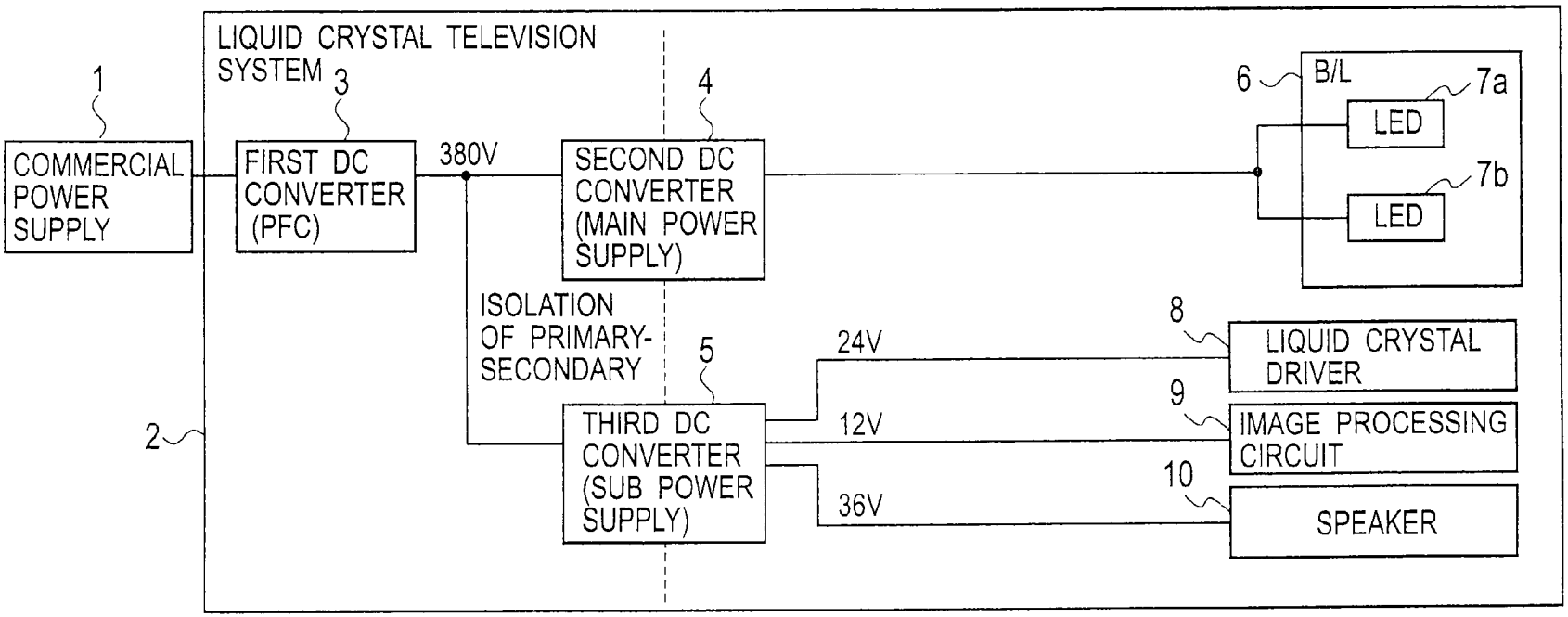
FIG. 2 is a circuit configuration diagram of a power converter of Embodiment 1 of the present invention.

FIG. 2 is a circuit configuration diagram of a power converter of Embodiment 1 of the present invention. The power converter shown in FIG. 2 includes a commercial power supply (alternating current (AC) power supply) 1 and a liquid crystal TV system 2. The liquid crystal TV system 2 includes a first direct current (DC) converter 3, a backlight (B/L) 6 having multiple LEDs (light-emitting load) 7*a* and 7*b* configured to emit light when supplied with predetermined DC voltage, a second DC converter 4, and a third DC converter 5.

The first DC converter 3 is configured to convert AC voltage from the commercial power supply 1, into DC voltage (DC 380 V, for example), and also to correct the power factor. The second DC converter 4 is a main power supply, and is configured to electrically isolate the first DC converter 3 from the B/L 6 having the LEDs 7*a* and 7*b*. The second DC converter 4 is also configured to convert the DC voltage from the first DC converter 3, into predetermined DC voltage, to supply the resultant voltage to the LEDs 7*a* and 7*b*, and to thereby cause the LEDs 7*a* and 7*b* to emit light.

A liquid crystal driver 8, an image processing circuit 9 and a speaker 10 correspond to multiple loads. The liquid crystal driver 8 is driven with DC 24 V, the image processing circuit 9 is driven with DC 12 V, and the speaker 10 is driven with DC 36 V.

The third DC converter 5 is a sub power supply, and is configured to electrically isolate the first DC converter 3 from the multiple loads 8 to 10. The third DC converter 5 is also configured to convert the DC voltage from the first DC converter 3 into multiple low DC voltages, DC 24 V, DC 12 V and DC 36 V, to supply the low DC voltages respectively to the liquid crystal driver 8, the image processing circuit 9 and the speaker 10, and to thereby drive the liquid crystal driver 8, the image processing circuit 9 and the speaker 10.

In Embodiment 1, an LED group load formed of the multiple LEDs is used as the light-emitting load. Alternatively, as long as emitting light with DC voltage, the light-emitting load may be an electroluminescence (EL) load or a field emission display (FED), for example.

Figure 3:
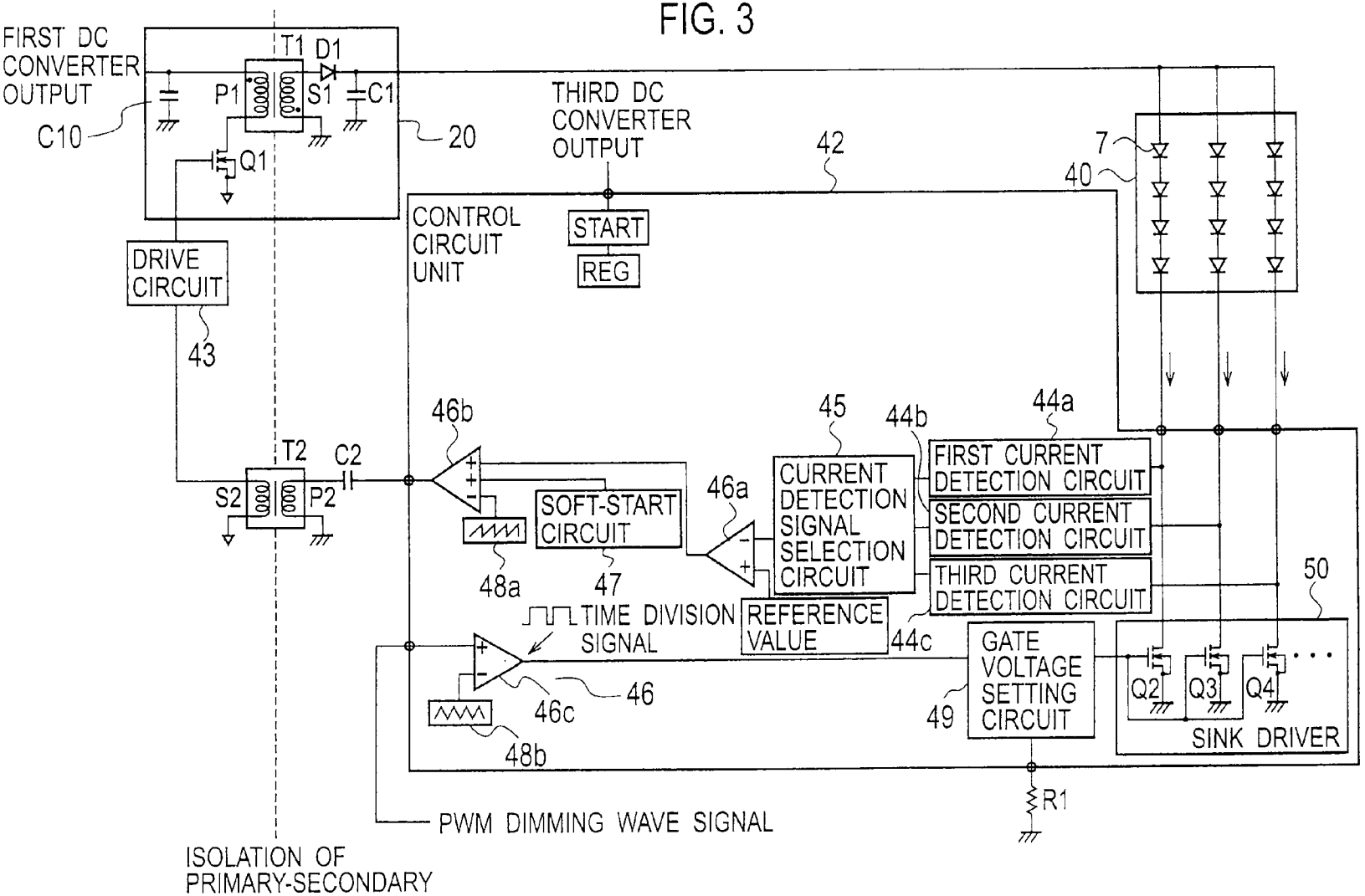
FIG. 3 is a circuit configuration diagram of a second DC converter provided in the power converter of Embodiment 1 of the present invention.

FIG. 3 is a circuit configuration diagram of the second DC converter provided in the power converter of Embodiment 1 of the present invention. The second DC converter 4 shown in FIG. 3 is a flyback converter including a transformer T1 configured to isolate the primary side and the secondary side from each other by using a primary winding P1 and a secondary winding S1. Alternatively, the second DC converter 4 may be a forward converter including the transformer T1 configured to isolate the primary side and the secondary side from each other.

The second DC converter 4 includes a converter circuit 20, a control circuit unit 42 and a gate voltage setting resistance R1.

An LED group load 7 corresponds to the B/L 6 having the multiple LEDs 7*a* and 7*b* in FIG. 2, and is configured by multiple LED groups ("3" groups in the example shown in FIG. 3) connected in parallel, the LED groups each formed of multiple LEDs connected in series. Here, the number of LED groups connected in parallel is not particularly limited. The LED group load 7 is connected between the output side of the converter circuit 20 and a sink driver 50 provided inside the control circuit unit 42.

The converter circuit 20 is configured to output voltage corresponding to a pulse width modulation (PWM) control signal transmitted from the control circuit unit 42. The output voltage from the converter circuit 20 is applied to the anode side of the LED group load 7.

The control circuit unit 42 includes first to third current detection circuits 44*a* to 44*c*, a current detection signal selection circuit 45, an error amplifier 46*a*, a PWM control comparator 46*b*, a time division circuit 46, a soft-start circuit 47, a sawtooth wave generation circuit 48*a*, a gate voltage setting circuit 49 and the sink driver 50.

The time division circuit 46 is disposed on the secondary side of the transformer T1, and is configured to generate a time division signal which indicates ON/OFF according to a duty cycle based on a DC PWM dimming control signal inputted from an external device. Specifically, the time division circuit 46 includes a triangular wave generation circuit 48*b* and a PWM dimming comparator (pulse conversion circuit of the present invention) 46*c*. The triangular wave generation circuit 48*b* is configured to generate a triangular wave signal and to then transmit the signal to the PWM dimming comparator 46*c*. The PWM dimming comparator 46*c* is configured to compare the PWM dimming signal inputted from the external device to a non-inverting input terminal (+) and the triangular wave signal inputted from the triangular wave generation circuit 48*b* to an inverting input terminal (−), and to then generate a rectangular wave time division signal. The time division signal outputted from the time division circuit 46 is transmitted to the gate voltage setting circuit 49, and thereby changes ON/OFF of a gate signal to be transmitted from the gate voltage setting circuit 49 to the sink driver 50.

The gate voltage setting circuit 49 is configured to generate a gate signal on the basis of the time division signal transmitted from the time division circuit 46, and of voltage set by the gate voltage setting resistance R1. The gate voltage setting circuit 49 then transmits the gate signal to the sink driver 50.

The sink driver 50 is configured by multiple (the same number as that of the LED groups) metal oxide semiconductor field effect transistors (MOSFETs) (Q2 to Q4 . . . ). The gate of each of the MOSFETs is connected to the gate voltage setting circuit 49, the drain thereof is connected to the cathode side of the LED group load 7, and the source thereof is grounded. The MOSFETs included in the sink driver 50 are configured to allow current to flow into the LED group load 7 to thereby cause the LED group load 7 to emit light, when being turned on according to a gate signal transmitted from the gate voltage setting circuit 49 in the state where the time division signal indicates ON. The MOSFETs are also configured to stop current from flowing into the LED group load 7 to thereby stop the LED group load 7 from emitting light, when being turned off according to a gate signal transmitted from the gate voltage setting circuit 49 in the state where the time division signal indicates OFF.

The brightness of the LED group load 7 can be adjusted according to an ON/OFF duty ratio of the time division signal, in other words, according to the DC PWM dimming signal inputted from the external device.

Here, three lines of current flowing into the LED group load 7 in the state where the time division signal indicates ON are not completely equal due to variations in LED forward voltage VF and the like.

The first to third current detection circuits 44*a* to 44*c* are disposed on the secondary side of the transformer T1. The first to third current detection circuits 44*a* to 44*c* are configured to detect the three lines of current flowing from the LED group load 7 into the sink driver 50, and to generate current detection signals corresponding respectively to the three lines of current. The current detection signal selection circuit 45 is configured to receive the three current detection signals, corresponding respectively to the three lines of current flowing from the LED group load 7 into the sink driver 50, to select one of the current detection signals, and to then transmit the selected current detection signal to the error amplifier 46*a*.

A method of selecting a current detection signal employed by the current detection signal selection circuit 45 may be to select the signal indicating the largest value or to select the signal indicating the smallest value of inputted the three current detection signals.

The error amplifier 46*a* is disposed on the secondary side of the transformer T1. The error amplifier 46*a* is configured to amplify the error between the voltage transmitted from the current detection signal selection circuit 45 and then inputted into an inverting input terminal (−) and voltage indicating a reference value and inputted to a non-inverting input terminal (+), and to then transmit the obtained voltage as a current feedback signal to the PWM control comparator 46*b*.

The soft-start circuit 47 is configured to generate a soft-start signal for gradually increasing voltage from low voltage (0 V, for example), and to then transmit the soft-start signal to the PWM control comparator 46*b*, when the control circuit 42 starts to operate.

The sawtooth wave generation circuit 48*a* is configured to generate a sawtooth wave signal, and to then transmit the signal to the PWM control comparator 46*b*. The PWM control comparator 46*b* is configured to generate a rectangular wave PWM control signal on the basis of the current feedback signal, transmitted from the error amplifier 46*a*, the soft-start signal, transmitted from the soft-start circuit 47, and the sawtooth wave signal, transmitted from the sawtooth wave generation circuit 48*a*.

Specifically, the PWM control comparator 46*b* is configured to compare the soft-start signal, transmitted from the soft-start circuit 47, and the sawtooth wave signal, transmitted from the sawtooth wave generation circuit 48*a*, and to thereby generate a PWM control signal whose pulse width gradually increases, for a certain time period after the control circuit 42 starts to operate. The PWM control comparator 46*b* is configured to compare the current feedback signal, transmitted from the error amplifier 46*a*, and the sawtooth wave signal, transmitted from the sawtooth wave generation circuit 48*a*, and to thereby generate a PWM control signal based on the current flowing into the LED group load 7, when the LED group load 7 emits light and the current feedback signal is transmitted from the error amplifier 46*a*.

A transformer T2 (signal transmission isolation element) includes a primary winding P2 and a secondary winding S2, and is configured to send the PWM control signal to a drive circuit 43 disposed on the primary side. A switching element Q1 is formed of a MOSFET, and is connected in series to the primary winding P1, connected to the output of the first DC converter 3, of the transformer T1. The drive circuit 43 is disposed on the primary side of the transformer T1, and is configured to transfer power from the primary side to the secondary side through the transformer T1 by turning on/off the switching element Q1 according to the PWM control signal transmitted from the transformer T2.

A diode D1 and a capacitor C1 form a rectifying/smoothing circuit rectifies and smoothes output voltage from the converter circuit 20.

Through the above-described operations, the converter circuit 20 controls on/off of the switching element Q1 on the basis of the current flowing into the LED group load 7 so that the current becomes to a predetermined current. Thus, the converter 20 is configured to supply required power to the LED group load 7, and to thereby perform control so that the power would be a predetermined value.

Figure 4:
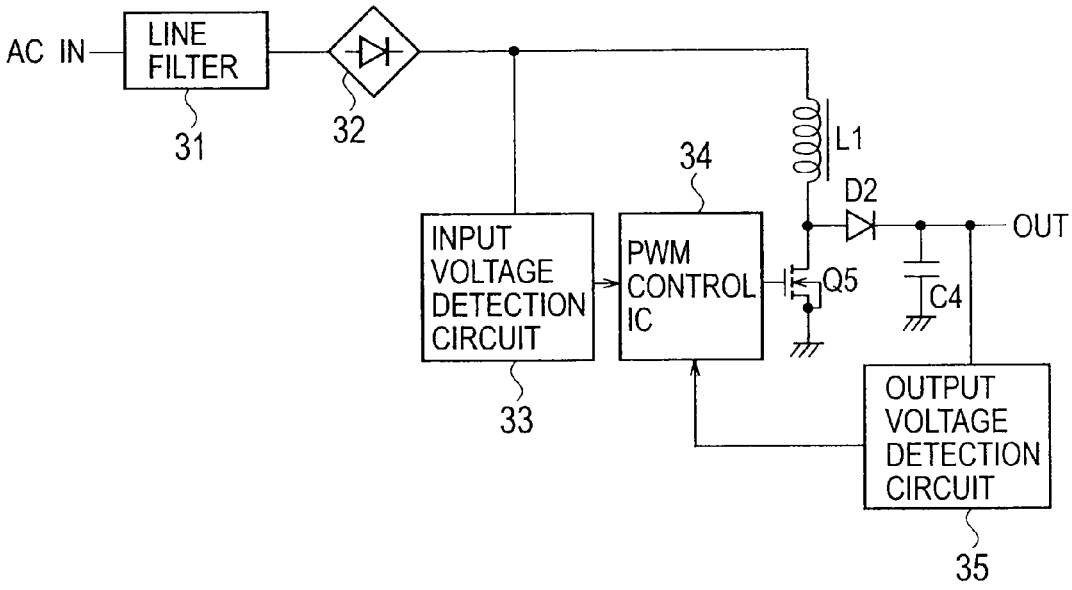
FIG. 4 is a circuit configuration diagram of a first DC converter provided in the power converter of Embodiment 1 of the present invention.

FIG. 4 is a circuit configuration diagram of the first DC converter provided in the power converter of Embodiment 1 of the present invention. In FIG. 4, a rectifying circuit 32 is configured to output rectified voltage obtained by rectifying AC voltage from the commercial power supply 1 through a line filter 31. When a switching element Q5 is turned on by a PWM control integrated circuit (IC) 34, the rectified voltage causes current to flow through a boosting reactor L1, the switching element Q5 and the ground in this order, and energy is stored in the boosting reactor L1. Subsequently, when the switching element Q5 is turned off, the energy stored in the boosting reactor L1 and the rectified voltage are outputted to a smoothing capacitor C4 through a diode D2. Thereby, the AC voltage is converted into DC voltage and also boosted.

An input voltage detection circuit 33 is configured to detect the rectified voltage and to output the detected voltage to the PWM control IC 34. An output voltage detection circuit 35 is configured to detect the output voltage from the smoothing capacitor C4 and to output the detected voltage to the PWM control IC 34. The PWM control IC 34 is configured to control ON/OFF of the switching element Q5 on the basis of the detected output voltage so that the voltage would be predetermined voltage, and to perform control so that the peak of current flowing through the switching element Q5 would be proportional to the wave form of the rectified voltage detected by the input voltage detection circuit 33, thereby correcting the power factor.

Although used as the circuit in FIG. 4 is an example of discontinuous conduction mode (DCM) circuits, which are a kind of boost chopper circuits, any circuit, such as a continuous conduction mode (CCM) circuit, an interleave circuit, a passive power factor correction (PFC) circuit, or any other kind of DC converter, may be used instead as long as having a power factor correction function.

Figure 5:
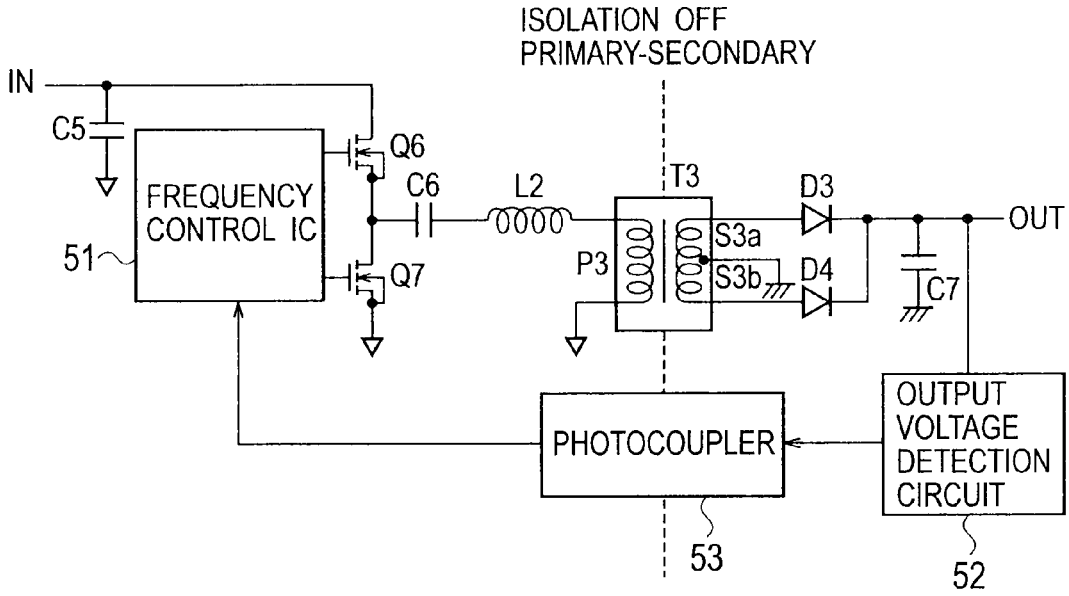
FIG. 5 is a circuit configuration diagram of a third DC converter provided in the power converter of Embodiment 1 of the present invention.

FIG. 5 is a circuit configuration diagram of the third DC converter provided in the power converter of Embodiment 1 of the present invention. The third DC converter 5 shown in FIG. 5 is formed of a forward converter including a transformer T3 configured to isolate the primary side and the secondary side from each other by a primary winding P3 and secondary windings S3*a* and S3*b*.

In FIG. 5, a series circuit including a switching element Q6 and a switching element Q7 each formed of a MOSFET is connected to the input side of the third DC converter 5, in other words, the output side of the first DC converter 3. To the junction point of the switching element Q6 and the switching element Q7, a series circuit including a capacitor C6, a reactor L2 and the primary winding P3 of the transformer T3 is connected.

In this configuration, when the switching element Q7 is turned off and the switching element Q6 is turned on by a frequency control IC 51, current flows through the power supply IN, the switching element Q6, the capacitor C6, the reactor L2 and the primary winding P3 in this order, on the primary side. Accordingly, on the secondary side, current flows through the secondary winding S3*a*, a diode D3 and a capacitor C7 in this order. When the switching element Q6 is turned off and the switching element Q7 is turned on by the frequency control IC 51, current flows through the primary winding P3, the reactor L2, the capacitor C6 and the switching element Q7 in this order, on the primary side. Accordingly, on the secondary side, current flows through the secondary winding S3*b*, a diode D4 and the capacitor C7 in this order.

An output voltage detection circuit 52 is configured to detect output voltage from the capacitor C7 and to output the detected voltage to the frequency control IC 51 through a photocoupler 53. The frequency control IC 51 controls ON/OFF of each of the switching element Q6 and the switching element Q7 on the basis of the output voltage from the capacitor C7 so that the output voltage would be predetermined voltage.

The third DC converter 5 may be a flyback converter, a resonant converter or any other kind of DC converter as long as having an isolation function.

Figure 1:
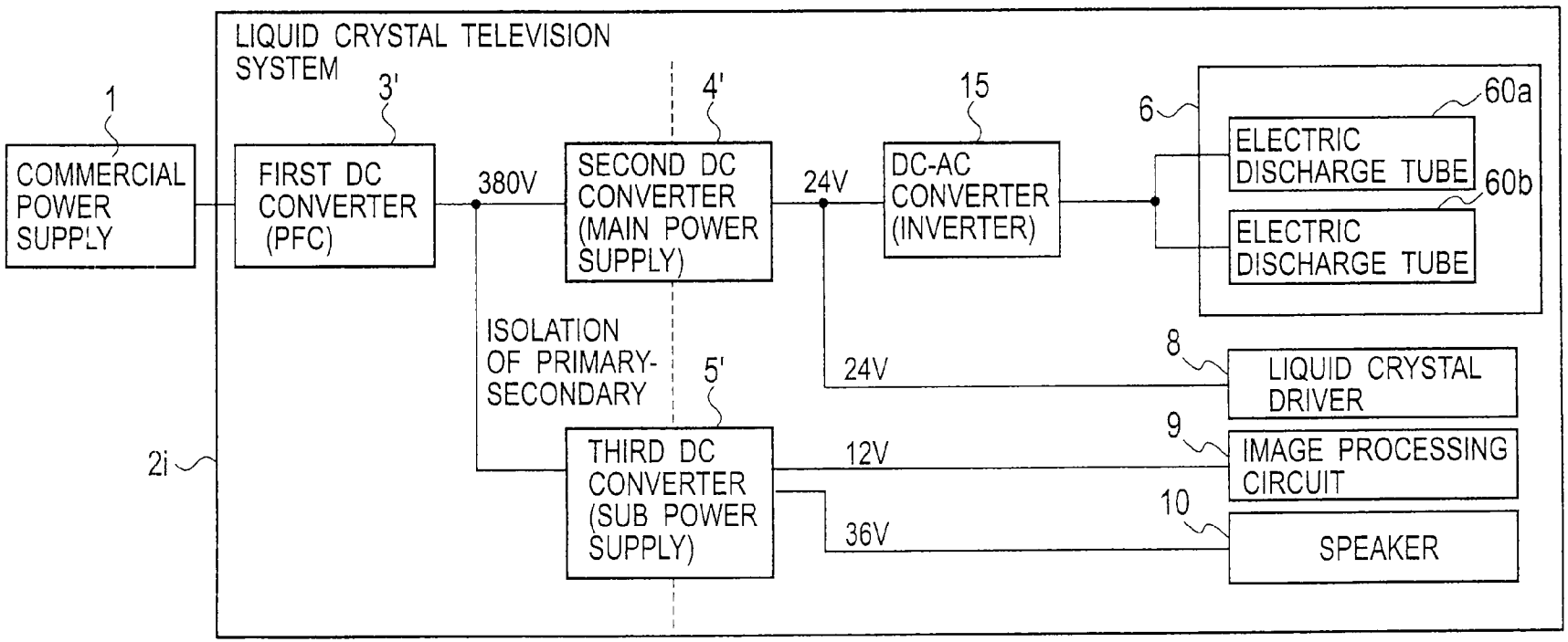
FIG. 1 (PRIOR ART)
FIG. 1 is a circuit configuration diagram showing an example of a conventional power converter.

As described above, according to the power converter of Embodiment 1, AC voltage from the commercial power supply 1 is converted into DC voltage by the first DC converter 3 and the second DC converter 4, and the LEDs 7*a* and 7*b* emit light with this DC voltage. Moreover, the number of power conversions performed in the course from the commercial power supply 1 to the LEDs 7*a* and 7*b* is reduced by one compared with that in the conventional circuit shown in FIG. 1. Hence, an inexpensive and highly-efficient power converter can be provided.

In addition, isolation between the primary side and the secondary side is made in the second DC converter 4. This eliminates unnecessary cost increase and efficiency decrease involved in the case of isolating between the primary side and the secondary side by the DC-AC converter 15.

Embodiment 2

Figure 6:
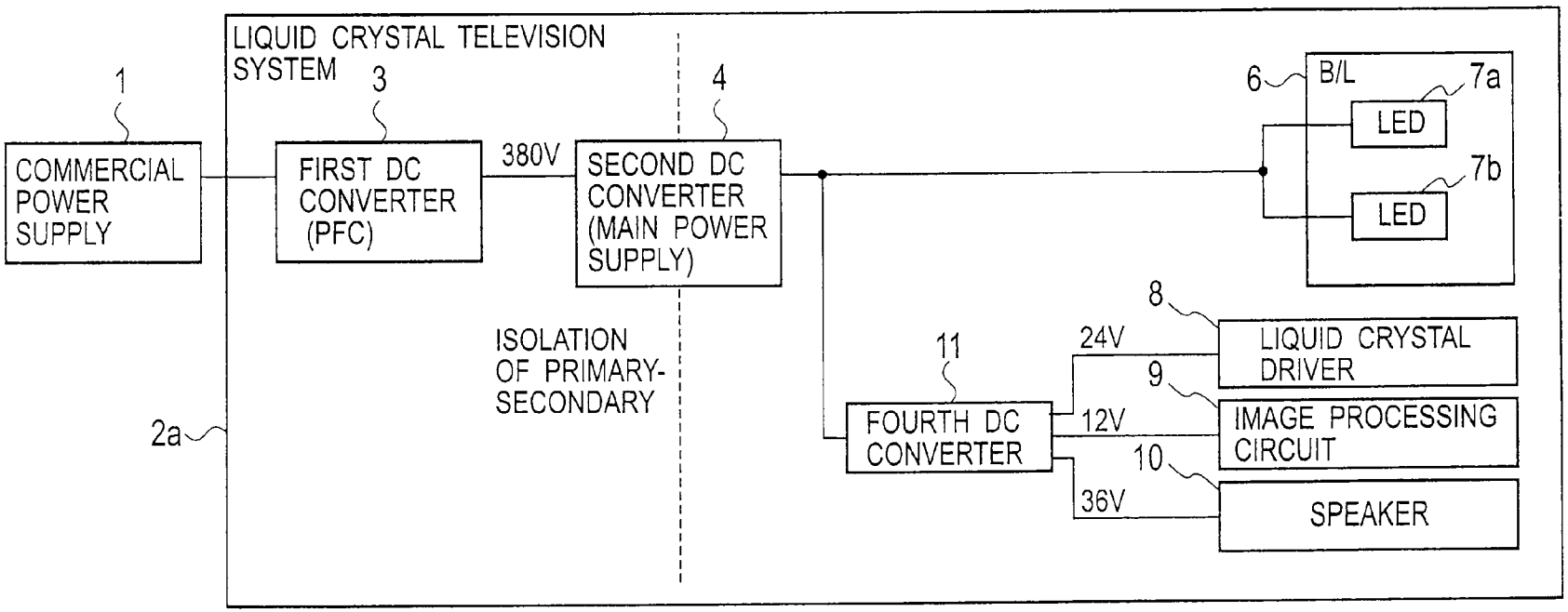
FIG. 6 is a circuit configuration diagram of a power converter of Embodiment 2 of the present invention.

FIG. 6 is a circuit configuration diagram of a power converter of Embodiment 2 of the present invention. The power converter shown in FIG. 6 has the following features. The third DC converter 5 of Embodiment 1 shown in FIG. 2 is omitted. A fourth DC converter 11 is connected to the output side of a second DC converter 4 while a liquid crystal driver 8, an image processing circuit 9 and a speaker 10 are connected to the output side of the fourth DC converter 11.

Figure 7:
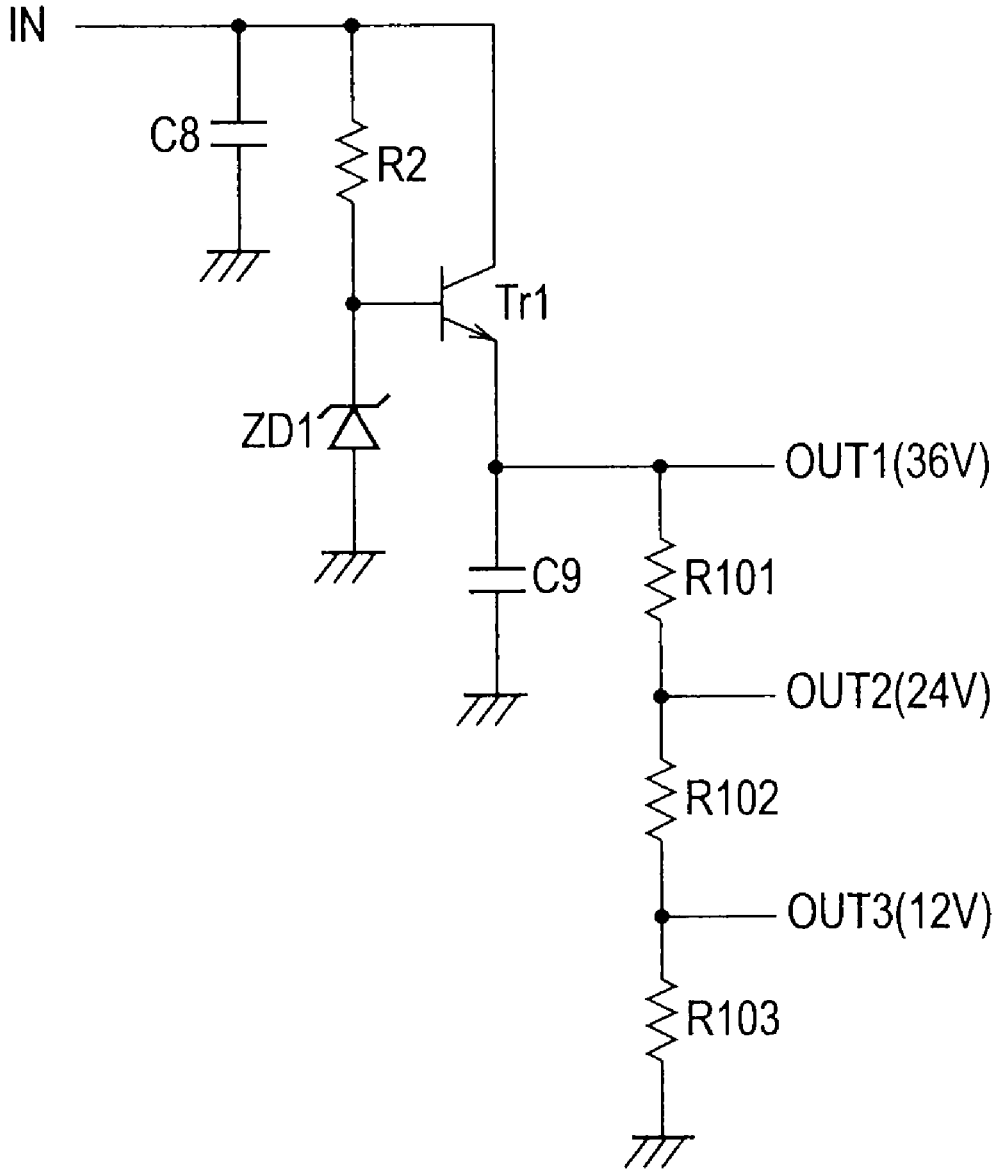
FIG. 7 is a circuit configuration diagram of a fourth DC converter provided in the power converter of Embodiment 2 of the present invention.

FIG. 7 is a circuit configuration diagram of the fourth DC converter provided in the power converter of Embodiment 2 of the present invention. In the fourth DC converter 11 shown in FIG. 7, one end of a capacitor C8, one end of a resistance R2 and the collector of a transistor Tr1 are connected to the input side (IN) of the second DC converter 4. The other end of the resistance R2, the base of the transistor Tr1 and the cathode of a zener diode ZD1 are connected. The emitter of the transistor Tr1 is connected to one end of a resistance R101 and one end of a capacitor C9. The other end of the resistance R101 is connected to one end of a resistance R102. The other end of the resistance R102 is connected to one end of a resistance R103. The other ends of the capacitors C8 and C9, the other end of the resistance R103 and the anode of the zener diode ZD1 are grounded.

With this configuration, DC voltage OUT1 can be obtained from the junction point of the emitter of the transistor Tr1 and the capacitor C9, DC voltage OUT2 can be obtained from the junction point of the resistance R101 and the resistance R102, and DC voltage OUT3 can be obtained from the junction point of the resistance R102 and the resistance R103.

Embodiment 2 having the above-described configuration can also achieve the same effects as those of Embodiment 1.

Embodiment 3

Figure 8:
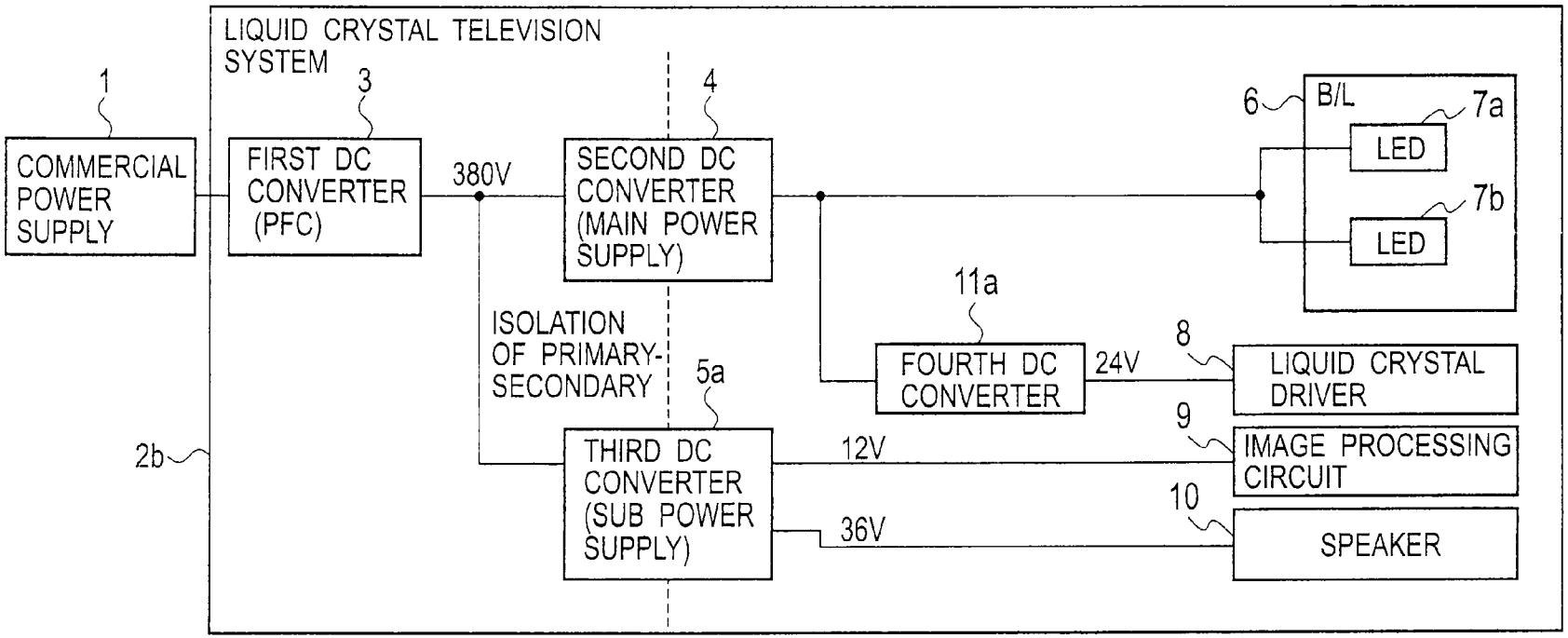
FIG. 8 is a circuit diagram of a power converter of Embodiment 3 of the present invention.

FIG. 8 is a circuit configuration diagram of a power converter of Embodiment 3 of the present invention. The power converter shown in FIG. 8 has the following features in comparison with Embodiment 1 shown in FIG. 2. A liquid crystal driver 8 is separated from the output side of a third DC converter 5*a* and is instead connected to the output side of a fourth DC converter 11*a*. The fourth DC converter 11*a* is configured to convert DC voltage from the output side of a second DC converter 4, into low DC voltage for driving the liquid crystal driver 8, and to then supply the low DC voltage to the liquid crystal driver 8.

Embodiment 3 having the above-described configuration can also achieve the same effects as those of Embodiment 1.

Embodiment 4

Figure 9:
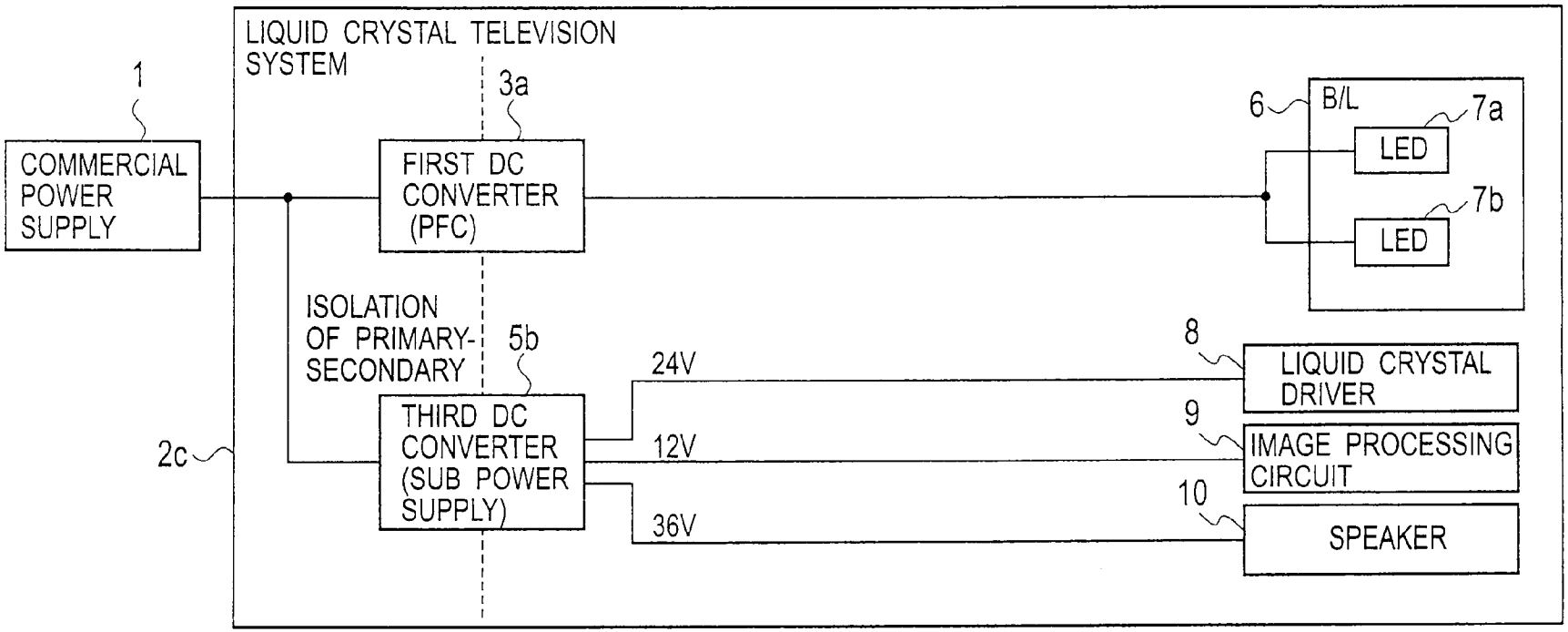
FIG. 9 is a circuit configuration diagram of a power converter of Embodiment 4 of the present invention.

FIG. 9 is a circuit configuration diagram of a power converter of Embodiment 4 of the present invention. The power converter shown in FIG. 9 includes a commercial power supply (AC power supply) 1 and a liquid crystal TV system 2*c*. The liquid crystal TV system 2*c* includes a first DC converter 3*a*, a B/L 6 having multiple LEDs 7*a* and 7*b*, a third DC converter 5*b*, a liquid crystal driver 8, an image processing circuit 9, and a speaker 10.

The first DC converter 3*a* is configured to electrically isolate the commercial power supply 1 from the LEDs 7*a* and 7*b*. Moreover, the first DC converter 3*a* is configured to convert AC voltage from the commercial power supply 1, into DC voltage (DC 380 V, for example), to correct the power factor and to then supply the voltage to the LEDs 7*a* and 7*b* so as to cause the LEDs 7*a* and 7*b* to emit light.

The third DC converter 5*b* is configured to electrically isolate the commercial power supply 1 from the multiple loads 8 to 10. The third DC converter 5*b* is also configured to convert the AC voltage from the commercial power supply 1, into multiple low DC voltages, DC 24 V, DC 12 V and DC 36 V, and to supply the low DC voltages respectively to the liquid crystal driver 8, the image processing circuit 9 and the speaker 10 to drive the liquid crystal driver 8, the image processing circuit 9 and the speaker 10.

Figure 10:
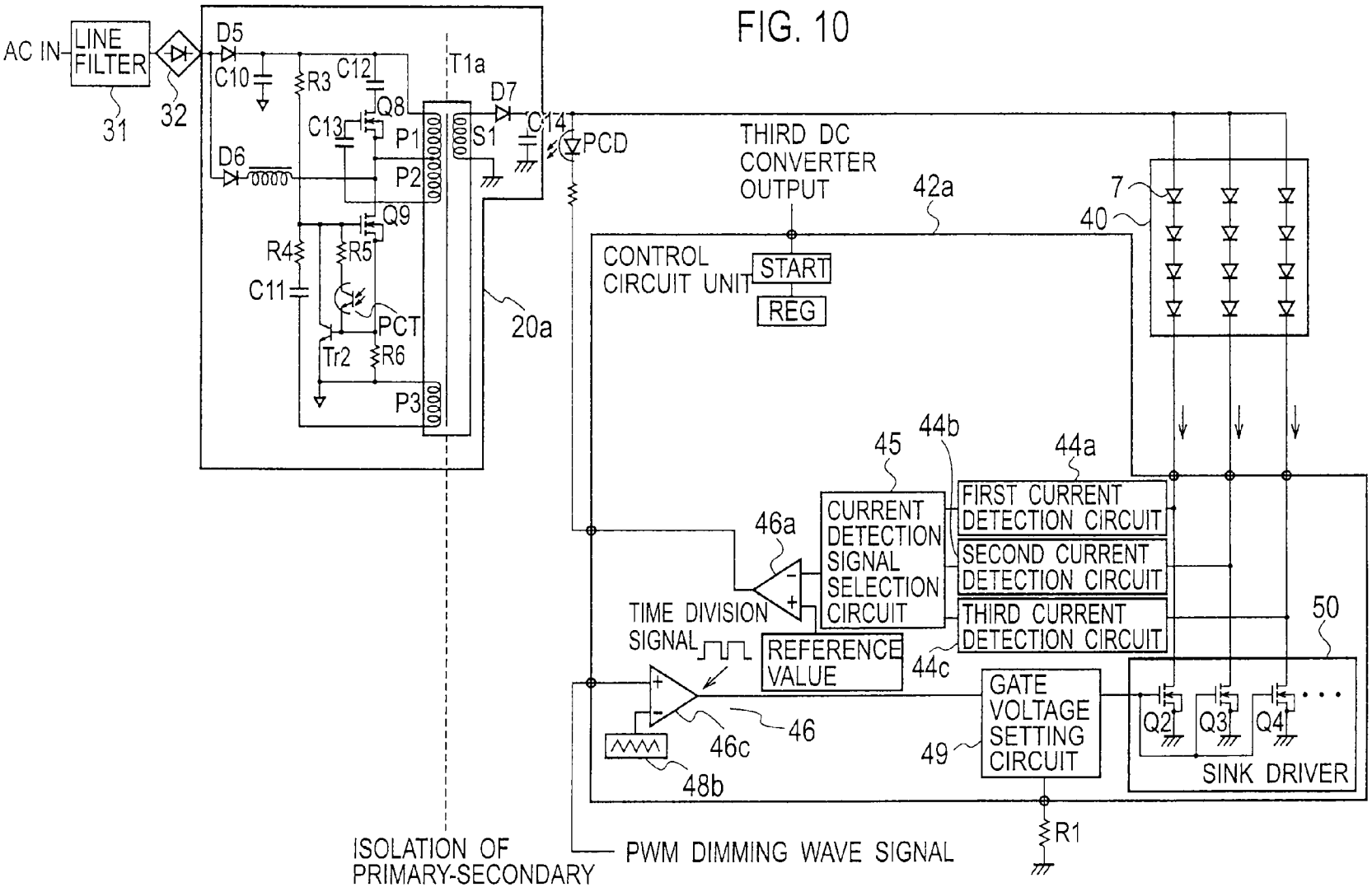
FIG. 10 is a circuit configuration diagram of a first DC converter provided in the power converter of Embodiment 4 of the present invention.

FIG. 10 is a circuit configuration diagram of the first DC converter provided in the power converter of Embodiment 4 of the present invention. The first DC converter 3*a* shown in FIG. 10 is formed of a converter including a transformer T1*a* configured to isolate between the primary side and the secondary side by a primary winding P1, a secondary winding S1 and auxiliary windings P2 and P3.

The first DC converter 3*a* includes a line filter 31, a rectifying circuit 32, a converter circuit 20*a*, a control circuit unit 42*a* and a gate voltage setting resistance R1. An LED group load 7 corresponds to the B/L 6 having the multiple LEDs (light-emitting load) 7*a* and 7*b* in FIG. 9, and is connected between the output side of the converter circuit 20*a* and a sink driver 50 provided inside the control circuit unit 42*a*.

After passing through the line filter 31, the AC voltage is rectified by the rectifying circuit 32, and is then transmitted to the converter circuit 20*a* including switching circuits Q8 and Q9, each formed of a MOSFET, and the transformer T1*a*.

The converter circuit 20*a* is a self-excited, two-transistor converter capable of correcting the power factor. The switching elements Q8 and Q9 are alternately turned on/off. The converter circuit 20*a* is configured to control a period in which the switching element Q9 is in an on state (timing of turning off the switching element Q9) according to a current feedback signal transmitted from the control circuit unit 42*a*, and to thereby output DC voltage which the LED group load 7 needs. The output voltage from the converter circuit 20*a* is applied to the anode side of the LED group load 7.

The control circuit unit 42*a* includes first to third current detection circuits 44*a* to 44*c*, a current feedback signal selection circuit 45, an error amplifier 46*a*, a time division circuit 46, a gate voltage setting circuit 49 and the sink driver 50.

The time division circuit 46, the gate voltage setting circuit 49, the sink driver 50, the first to third current detection circuits 44*a* to 44*c* and the current feedback signal selection circuit 45 have the same configurations as those shown in FIG. 3, and hence descriptions of these are omitted here.

The error amplifier 46*a* is disposed on the secondary side of the transformer T1*a*. The error amplifier 46*a* is configured to amplify the error between voltage transmitted from the current feedback signal selection circuit 45 and then inputted to an inverting input terminal (−) and voltage inputted to a non-inverting input terminal (+) and indicating a reference value, and to then transmit the obtained voltage as a current feedback signal to a diode PCD of a photocoupler PC.

When current corresponding to the current feedback signal flows into the diode PCD of the photocoupler PC, the diode PCD emits light, and a transistor PCT of the photocoupler PC receives the light. In other words, the current feedback is sent to the primary side by the photocoupler PC. The ON/OFF control of the switching elements Q8 and Q9 is performed by determining a period in which the switching element Q9 is in an ON state (timing of turning off the switching element Q9) according to the current feedback sent to the primary side. Thereby, power which the LED group load 7 needs is transferred from the primary side to the secondary side through the transformer T1*a*.

The primary DC converter 3*a* may be a separately-excited, two-transistor converter (active clamp converter) or any other kind of DC converter as long as having an isolation function, a boosting function and a power factor correction function.

As described above, according to the power converter of Embodiment 4, AC voltage from the commercial power supply 1 is converted into DC voltage by the first DC converter 3*a*, and the LEDs 7*a* and 7*b* emit light with this DC voltage. Moreover, the number of power conversions performed in the course from the commercial power supply 1 to the LEDs 7*a* and 7*b* is reduced by two compared with that in the conventional circuit shown in FIG. 1. Hence, an inexpensive and highly-efficient power converter can be provided.

In addition, isolation between the primary side and the secondary side is made in the first DC converter 3*a*. This eliminates unnecessary cost increase and efficiency decrease involved in the case of isolating between the primary side and the secondary side by the DC-AC converter 15.

Embodiment 5

Figure 11:
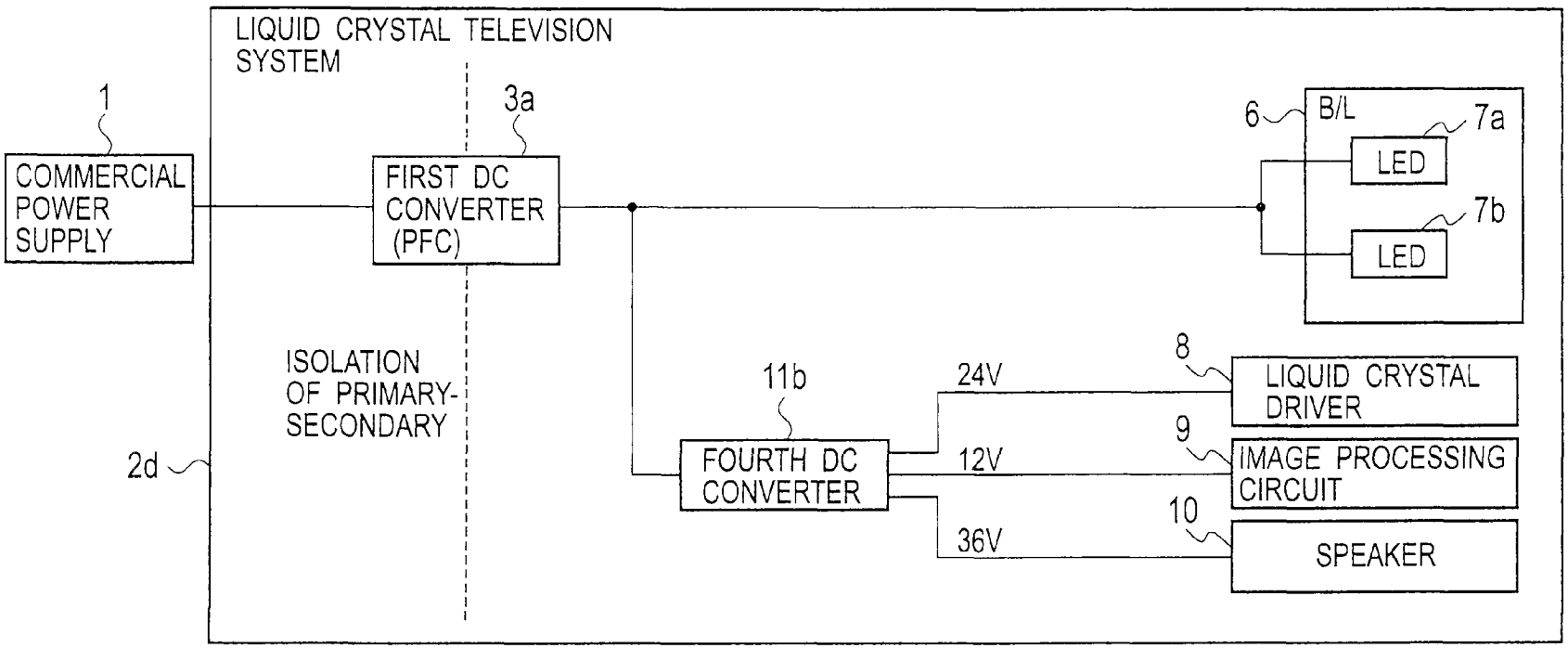
FIG. 11 is a circuit configuration diagram of a power converter of Embodiment 5 of the present invention.

FIG. 11 is a circuit configuration diagram of a power converter of Embodiment 5 of the present invention. The Embodiment 5 shown in FIG. 11 has the following features. The third DC converter 5*b* of Embodiment 4 shown in FIG. 9 is omitted. A fourth DC converter 11*b* is connected to the output side of a first DC converter 3*a*, and a liquid crystal driver 8, an image processing circuit 9 and a speaker 10 are connected to the output side of the fourth DC converter 11*b*.

Embodiment 5 having the above-described configuration can also achieve the same effects as those of Embodiment 4.

Embodiment 6

Figure 12:
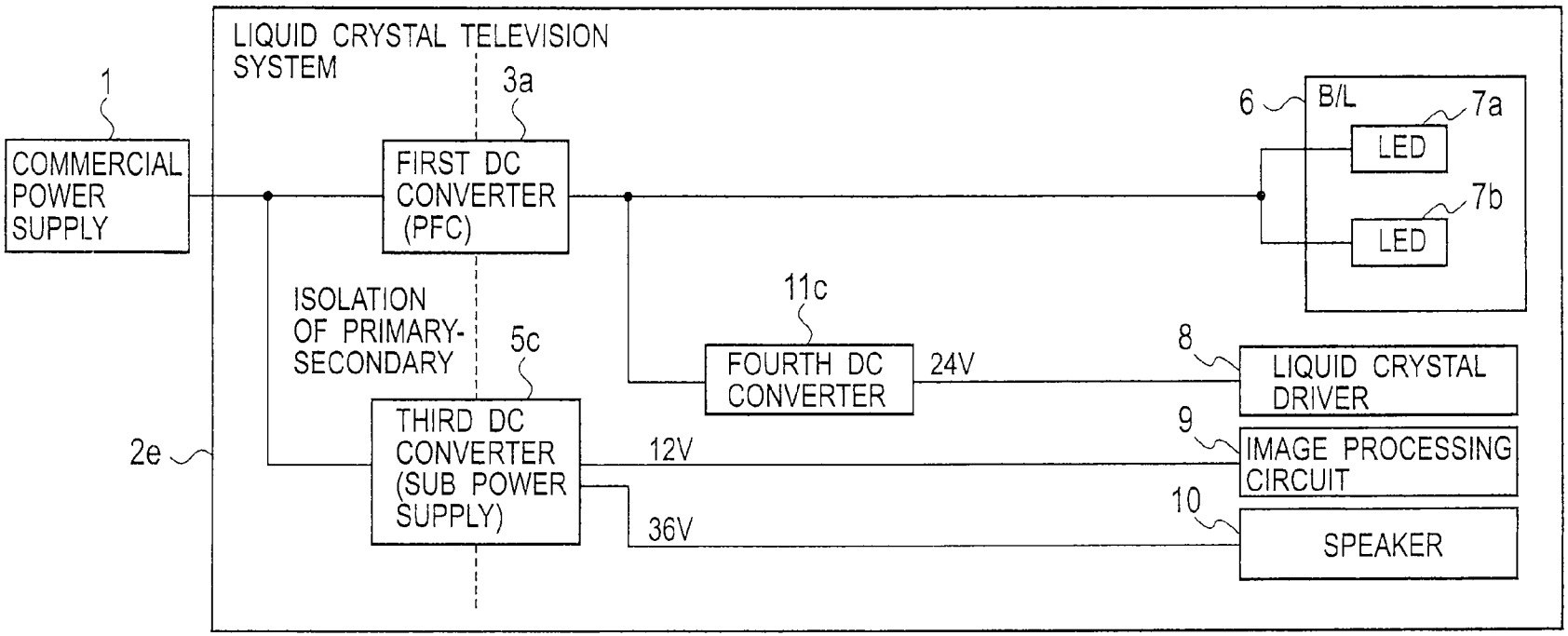
FIG. 12 is a circuit configuration diagram of a power converter of Embodiment 6 of the present invention.

FIG. 12 is a circuit configuration diagram of a power converter of Embodiment 6 of the present invention. Embodiment 6 shown in FIG. 12 has the following features in comparison with Embodiment 4 shown in FIG. 9. A liquid crystal driver 8 is separated from the output side of a third DC converter 5*c*, and is instead connected to the output side of a fourth DC converter 11*c*. The fourth DC converter 11*c* is configured to convert DC voltage from the output side of a first DC converter 3*a*, into low DC voltage for driving the liquid crystal driver 8, and to then supply the low DC voltage to the liquid crystal driver 8.

Embodiment 6 having the above-described configuration can also achieve the same effects as those of Embodiment 4.

Embodiment 7

Figure 13:
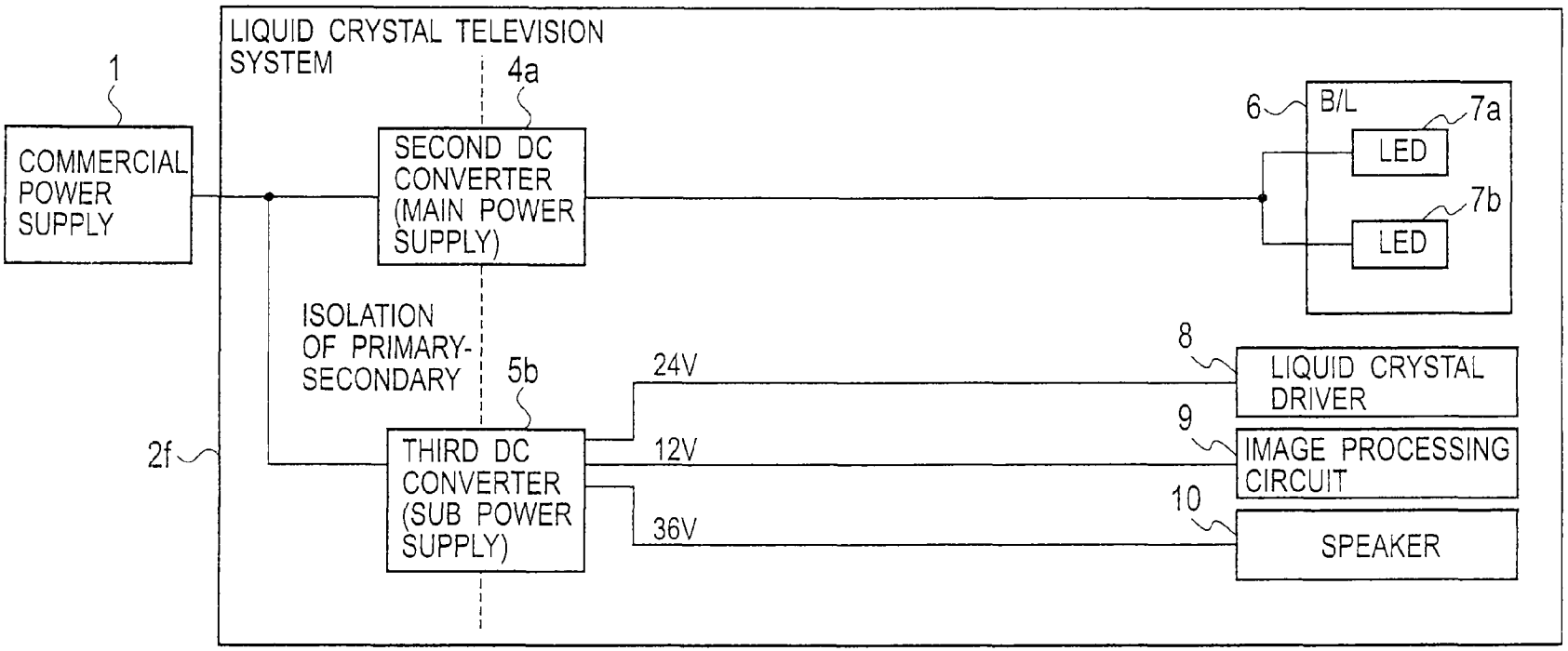
FIG. 13 is a circuit configuration diagram of a power converter of Embodiment 7 of the present invention.

FIG. 13 is a circuit configuration diagram of a power converter of Embodiment 7 of the present invention. The power converter shown in FIG. 13 includes a commercial power supply (AC power supply) 1 and a liquid crystal TV system 2*f*. The liquid crystal TV system 2*f* includes a second DC converter 4*a*, a B/L 6 having multiple LEDs 7*a* and 7*b*, a third DC converter 5*b*, a liquid crystal driver 8, an image processing circuit 9 and a speaker 10.

The second DC converter 4*a* is configured to electrically isolate the commercial power supply 1 from the LEDs 7*a* and 7*b*. The second DC converter 4*a* is also configured to convert AC voltage from the commercial power supply 1, into DC voltage, and to then supply the DC voltage to the LEDs 7*a* and 7*b* to cause the LEDs 7*a* and 7*b* to emit light.

The third DC converter 5*b* is configured to electrically isolate the commercial power supply 1 from the multiple loads 8 to 10. The third DC converter 5*b* is also configured to convert the AC voltage from the commercial power supply 1, into multiple low DC voltages, DC 24 V, DC 12 V and DC 36 V, and to then supply the low DC voltages respectively to the liquid crystal driver 8, the image processing circuit 9 and the speaker 10 to drive the liquid crystal driver 8, the image processing circuit 9 and the speaker 10.

FIG. 14 is a circuit configuration diagram of the second DC converter provided in the power converter of Embodiment 7 of the present invention. The second DC converter 4*a* shown in FIG. 14 has the same configuration as that of the second DC converter 4 of Embodiment 1 shown in FIG. 3 except for the following feature. A line filter 31 and a rectifying circuit 32 are added to the input side of the second DC converter 4*a*.

As described above, for example, when the total power consumption of the entire converter is not more than 75 W and no countermeasures against higher harmonic are needed, the AC voltage from the commercial power supply 1 is converted into the DC voltage by the second DC converter 4*a* as in the power converter of Embodiment 7. The LEDs 7*a* and 7*b* emit light with the DC voltage, and the number of power conversions performed in the course from the commercial power supply 1 to the LEDs 7*a* and 7*b* is reduced. Thereby, an inexpensive and highly-efficient power converter can be provided.

In addition, isolation between the primary side and the secondary side is made in the second DC converter 4*a*. This eliminates unnecessary cost increase and efficiency decrease involved in the case of isolating between the primary side and the secondary side by the DC-AC converter 15.

Embodiment 8

Figure 15:
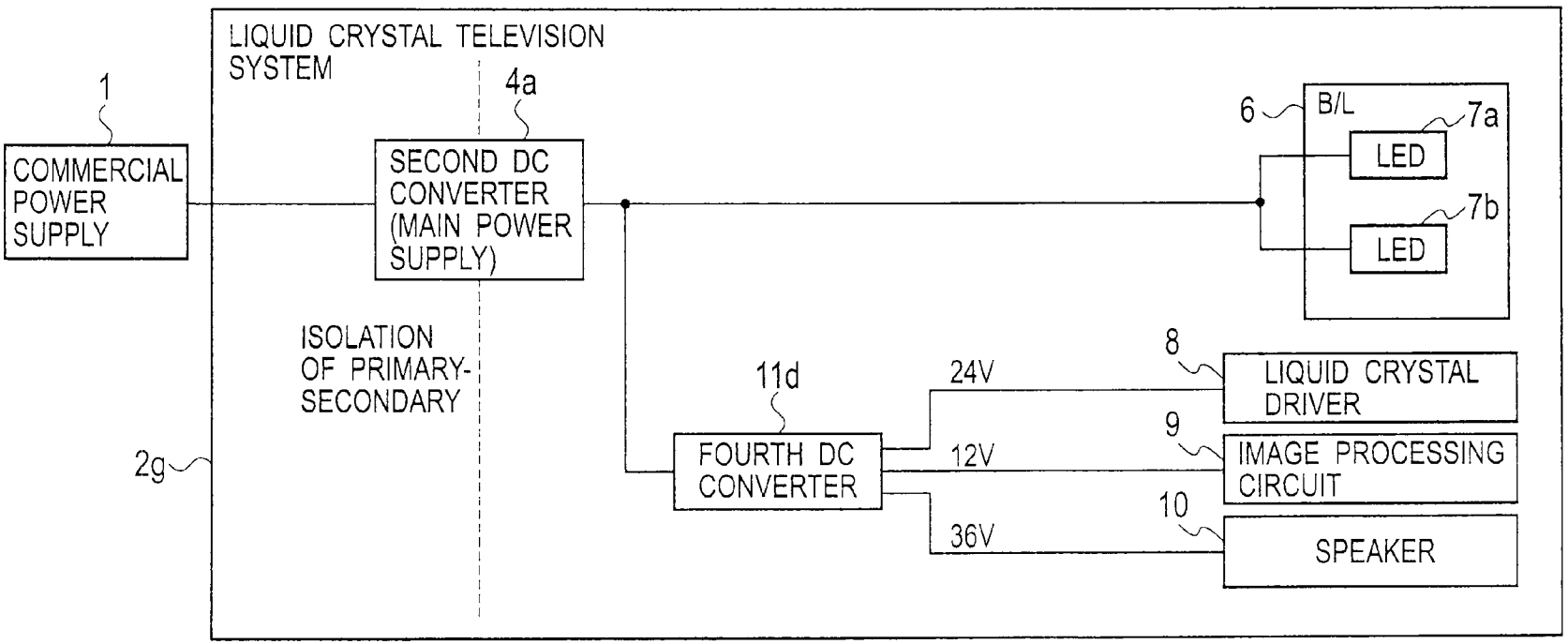
FIG. 15 is a circuit configuration diagram of a power converter of Embodiment 8 of the present invention.

FIG. 15 is a circuit configuration diagram of a power converter of Embodiment 8 of the present invention. Embodiment 8 shown in FIG. 15 has the following features. The third DC converter 5*b* of Embodiment 7 shown in FIG. 13 is omitted. A fourth DC converter 11*d* is connected to the output side of a second DC converter 4*a*, and a liquid crystal driver 8, an image processing circuit 9 and a speaker 10 are connected to the output side of the fourth DC converter 11*d*.

Embodiment 8 having the above-described configuration can also achieve the same effects as those of Embodiment 7.

Embodiment 9

Figure 16:
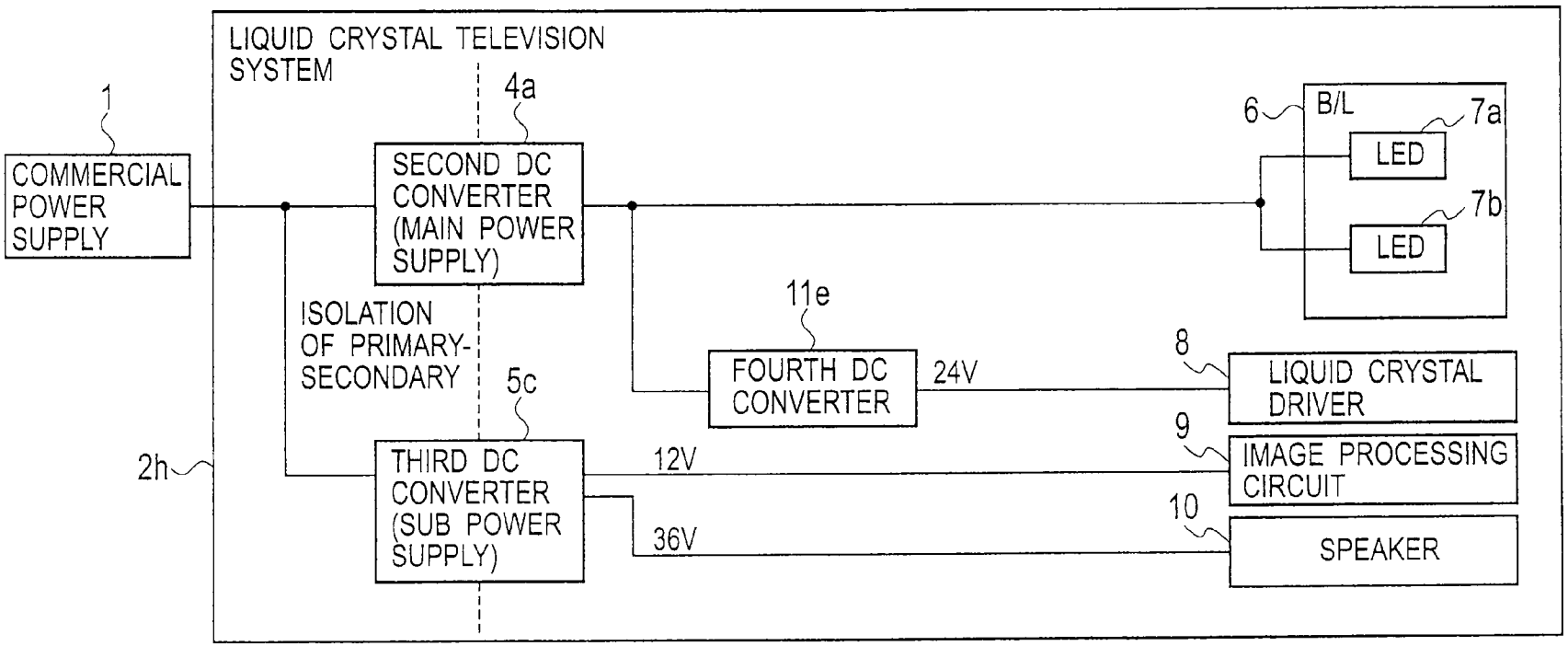
FIG. 16 is a circuit configuration diagram of a power converter of Embodiment 9 of the present invention.

FIG. 16 is a circuit configuration diagram of a power converter of Embodiment 9 of the present invention. Embodiment 9 shown in FIG. 16 has the following features in comparison with Embodiment 7 shown in FIG. 13. A liquid crystal driver 8 is separated from the output side of a third DC converter 5*c*, and is instead connected to the output side of a fourth DC converter 11*e*. The fourth DC converter 11*e* is configured to convert DC voltage from the output side of a second DC converter 4*a*, into low DC voltage for driving the liquid crystal driver 8, and to then supply the low DC voltage to the liquid crystal driver 8.

Embodiment 9 having the above-described configuration can also achieve the same effects as those of embodiment 7.

The present invention can provide an inexpensive and highly-efficient power converter which is capable of converting AC voltage from an AC power supply, into DC voltage, and of driving an LED group load electrically isolated from the AC power supply, with the DC voltage, and which performs a reduced number of power conversions in the course from the AC power supply to the LED group load.

What is claimed is:

1. A power converter comprising:

a first direct current converter configured to convert alternating current voltage from an alternating current power supply, into direct current voltage, and to correct a power factor;

an LED group load configured to emit light with predetermined direct current voltage; and a second direct current converter configured to electrically isolate the first direct current converter and the LED group load from each other, and to convert the direct current voltage from the first direct converter, into the predetermined direct current voltage and then supply the predetermined direct voltage to the LED group load, wherein the second direct current converter includes:

a transformer configured to isolate a primary side and a secondary side from each other;

a current detection circuit disposed on the secondary side of the transformer, and configured to detect current flowing into the LED group load;

an error amplifier configured to amplify an error between a current value detected by the current detection circuit and a reference current value;

a signal transmission isolation element configured to transmit a control signal based on an output signal from the error amplifier, to the primary side; and a switching element disposed on the primary side, and configured to transfer power to the secondary side through the transformer by being turned on/off according to the control signal transmitted from the signal transmission isolation element.

2. The power converter according to claim 1, wherein the second direct current converter includes, on the secondary side of the transformer, a time division circuit configured to cause current to intermittently flow into the LED group load according to a PWM dimming signal.

3. The power converter according to claim 1, wherein the second direct current converter includes, on the primary side of the transformer, a drive circuit configured to turn on/off the switching element.

4. The power converter according to claim 1, wherein the second direct current converter includes, on one of the primary side and the secondary side of the transformer, a pulse conversion circuit configured to generate a pulse signal for turning on/off the switching element.

5. A power converter comprising a first direct current converter configured to electrically isolate an alternating current power supply and an LED group load from each other, and to convert alternating current voltage from the alternating current power supply, into direct current voltage while correcting a power factor, and then supply the direct current voltage to the LED group load, wherein the first direct current converter includes:

a transformer configured to isolate a primary side and a secondary side from each other;

a current detection circuit disposed on the secondary side of the transformer, and configured to detect current flowing into the LED group load;

an error amplifier configured to amplify an error between a current value detected by the current detection circuit and a reference current value;

a signal transmission isolation element configured to transmit a control signal based on an output signal from the error amplifier, to the primary side; and a switching element disposed on the primary side, and configured to transfer power to the secondary side through the transformer by being turned on/off according to the control signal transmitted from the signal transmission isolation element.

6. The power converter according to claim 5, wherein the first direct current converter includes, on the secondary side of the transformer, a time division circuit configured to cause current to intermittently flow into the LED group load according to a PWM dimming signal.

7. The power converter according to claim 5, wherein the first direct current converter includes, on the primary side of the transformer, a drive circuit configured to turn on/off the switching element.

8. The power converter according to claim 5, wherein the first direct current converter includes, on one of the primary side and the secondary side of the transformer, a pulse conversion circuit configured to generate a pulse signal for turning on/off the switching element.

9. A power converter comprising a second direct current converter configured to electrically isolate an alternating current power supply and an LED group load from each other, and to convert alternating current voltage from the alternating current power supply, into direct current voltage and then supply the direct current voltage to the LED group load, wherein the second direct current converter includes:

a transformer configured to isolate a primary side and a secondary side from each other;

a current detection circuit disposed on the secondary side of the transformer, and configured to detect current flowing into the LED group load;

an error amplifier configured to amplify an error between a current value detected by the current detection circuit and a reference current value;

a signal transmission isolation element configured to transmit a control signal based on an output signal from the error amplifier, to the primary side; and a switching element disposed on the primary side, and configured to transfer power to the secondary side through the transformer by being turned on/off according to the control signal transmitted from the signal transmission isolation element.

10. The power converter according to claim 9, wherein the second direct current converter includes, on the secondary side of the transformer, a time division circuit configured to cause current to intermittently flow into the LED group load according to a PWM dimming signal.

11. The power converter according to claim 9, wherein the second direct current converter includes, on the primary side of the transformer, a drive circuit configured to turn on/off the switching element.

12. The power converter according to claim 9, wherein the second direct current converter includes, on one of the primary side and the secondary side of the transformer, a pulse conversion circuit configured to generate a pulse signal for turning on/off the switching element.

13. A power converter comprising:

a first direct current converter configured to convert alternating current voltage from an alternating current power supply through a line filter, into direct current voltage, and to correct a power factor;

an LED group load configured to emit light with predetermined direct current voltage; and a second direct current converter configured to electrically isolate the first direct current converter and the LED group load from each other, and to convert the direct current voltage from the first direct converter, into the predetermined direct current voltage and then supply the predetermined direct voltage to the LED group load, wherein the second direct current converter includes:

a transformer configured to isolate a primary side and a secondary side from each other by using a primary winding and a second winding;

a rectifying/smoothing circuit disposed on the secondary side, and configured to include a diode and a capacitor;

a current detection circuit configured to detect current flowing into the LED group load, and to generate current detection signal corresponding to the current;

an error amplifier configured to amplify an error between the current detection signal generated by the current detection circuit and a reference current value;

a pulse signal generation circuit configured to generate pulse signal; and a switching element configured to transfer power to the secondary side through the transformer by being turned on/off according to control signal based on output signal of the error amplifier and the pulse signal.

14. The power converter according to claim 13, wherein the second direct current converter includes, a time division circuit configured to cause current to intermittently flow into the LED group load according to a DC PWM dimming signal.

15. A power converter comprising a first direct current converter configured to electrically isolate an alternating current power supply and an LED group load from each other, and to convert alternating current voltage from the alternating current power supply through a line filter, into direct current voltage while correcting a power factor, and then supply the direct current voltage to the LED group load, wherein the first direct current converter includes:

a transformer configured to isolate a primary side and a secondary side from each other by using a primary winding and a second winding;

a rectifying/smoothing circuit disposed on the secondary side, and configured to include a diode and a capacitor;

a current detection circuit configured to detect current flowing into the LED group load, and to generate current detection signal corresponding to the current;

an error amplifier configured to amplify an error between a current value detected by the current detection circuit and a reference current value;

an error amplifier configured to amplify an error between the current detection signal generated by the current detection circuit and a reference current value;

a pulse signal generation circuit configured to generate pulse signal; and a switching element configured to transfer power to the secondary side through the transformer by being turned on/off according to control signal based on output signal of the error amplifier and the pulse signal.

16. The power converter according to claim 15, wherein the second direct current converter includes, a time division circuit configured to cause current to intermittently flow into the LED group load according to a DC PWM dimming signal.

17. A power converter comprising a second direct current converter configured to electrically isolate an alternating current power supply and an LED group load from each other, and to convert alternating current voltage from the alternating current power supply through a line filter, into direct current voltage and then supply the direct current voltage to the LED group load, wherein the second direct current converter includes:

a transformer configured to isolate a primary side and a secondary side from each other by using a primary winding and a second winding;

a rectifying/smoothing circuit disposed on the secondary side, and configured to include a diode and a capacitor;

a current detection circuit configured to detect current flowing into the LED group load, and to generate current detection signal corresponding to the current;

an error amplifier configured to amplify an error between a current value detected by the current detection circuit and a reference current value;

an error amplifier configured to amplify an error between the current detection signal generated by the current detection circuit and a reference current value;

a pulse signal generation circuit configured to generate pulse signal; and a switching element configured to transfer power to the secondary side through the transformer by being turned on/off according to control signal based on output signal of the error amplifier and the pulse signal.

18. The power converter according to claim 17, wherein the second direct current converter includes, a time division circuit configured to cause current to intermittently flow into the LED group load according to a DC PWM dimming signal.

* * * * *